United States Patent [19]

Nealy

[11] 4,267,615

[45] May 19, 1981

[54] LEASH TO SURF MAT CONNECTOR

[76] Inventor: Robert B. Nealy, 129 Ladera La., San Clemente, Calif. 92672

[21] Appl. No.: 906,402

[22] Filed: May 15, 1978

[51] Int. Cl.[3] ..... A63C 15/06

[52] U.S. Cl. ..... 9/310 E; 24/104; 24/105; 24/221 R; 410/101

[58] Field of Search ..... 9/310 E, 310 A, 310 B, 9/310 C; 280/12 H, 18, 606; 24/115 K, 221, 109, 104, 105, 219, 220, 221 R; 115/6.1; 272/1 B; 410/101-116; 85/5 P

[56] References Cited

U.S. PATENT DOCUMENTS

| | | | |
|---|---|---|---|
| 555,995 | 3/1896 | Beaumont | 24/109 |
| 643,579 | 2/1900 | Wertz, Jr. | 24/109 |
| 2,659,122 | 11/1953 | Golubics | 24/221 R |
| 2,835,948 | 5/1958 | Blake | 24/105 |
| 3,088,748 | 5/1963 | Malmo | 280/606 |
| 3,125,036 | 3/1964 | Reynolds | 410/114 |
| 3,341,905 | 9/1967 | Gill | 24/105 |
| 3,378,275 | 4/1968 | Rockwood et al. | 280/606 |
| 4,006,503 | 2/1977 | Wood | 9/310 E |

OTHER PUBLICATIONS

Brochure for "Morey Boogie Leash".

*Primary Examiner*—Charles E. Frankfort
*Attorney, Agent, or Firm*—Martin A. Voet

[57] ABSTRACT

A connector for attaching a leash to a surf mat comprising a shank member, a head coupled to one end of the shank member, and a coupling member attachable to the other end of the shank member. The shank member is adapted to project through a resilient surf mat with the head and the coupling member lying on the opposite faces of the surf mat. The outer surfaces of the head and coupling member are smooth and neither the head nor the coupling member project substantially, if at all, from the associated face of the surf mat. The resilience of the surf mat can be used to enhance the attachment between the coupling member and the shank member. The leash is attached at one end to the connector and at the other end to the surfer.

9 Claims, 5 Drawing Figures

LEASH TO SURF MAT CONNECTOR

BACKGROUND OF THE INVENTION

Surf mats have become very popular for wave riding. A typical surf mat includes a panel of foam plastic which may be somewhat flexible and resilient. Because of the likelihood of the surf mat washing to shore when the rider falls off of the mat, it is a common practice to use a leash to connect the surfer's wrist to the mat.

Known methods of attaching the leash to the surf mat are time consuming in that they require cutting of the material of the mat, inserting a connecting device and gluing. In addition, these methods leave protrusions on the top of the surf mat, and this presents a serious hazard to the surfer, particularly when the surfer is violently removed from the board by a large wave. There is also a tendency of some prior art connectors to destroy the material of the board around the connector, thereby increasing the likelihood that the connector-to-surf mat joint will fail.

SUMMARY OF THE INVENTION

This invenion provides a connector for attaching a leash to various different kinds of surfing panels. Although the connector is partially adapted for use with surf mats, i.e., surfing panels which are relatively soft, it can also be used with hard surfboards. The connector of this invention is very easy to install and it can be easily installed by the user on existing surfing panels. When installed, the connector protrudes only slightly, if at all, from the panel to which it is attached and, therefore, it poses no hazard to the user.

The connector can advantageously include a shank member, a head member coupled to one end of the shank member, and a coupling member. The coupling member has a passage which receives the other end of the shank member. Attaching means attaches the coupling member to the shank member with the shank membe being received by the passage in the coupling member. The leash is attached to at least one of the members of the connector.

To install the connector, the shank is simply driven into the material of the panel and/or a passage through the panel can be provided by an appropriate tool. For example, in the case of a soft, plastic panel, a pencil can be used to form the passage. The coupling member is then attached to the free end of the shank member using the attaching means. When so attached, the coupling member and the head member are separated by the panel are joined together by the shank member. Preferably, the coupling member and the head member have relatively broad inner surfaces to provide substantial bearing areas against the opposed faces of the panel so that wear on the panels minimized.

To minimize the likelihood of injury to the surfer, the outer surfaces of the coupling member and head member are preferably smooth. In addition, these members are preferably substantially flush with the opposite faces, respectively, of the panel. To minimize protrusions, the head member and coupling member preferably include thin flanges defining their respective peripheries. In addition, the coupling member and head member are cinched down tightly against the opposite faces of the panel. When the panel is resilient, a region of the panel is preferably resiliently compressed between the head member and the connector member to thereby tend to countersink these members into the panel.

When the panel is compressed, the reaction force from the panel urges the head member and the coupling member away from each other. With one form of this invention, the attaching means includes means responsive to the urging of the head member and the coupling member away from each other to more tightly attach the coupling member to the shank member. This can be implemented, for example, by using attaching means which locks in response to a predetermined amount of rotation between the shank member and the head member. In this event, the interlock can be provided by a projection on one of the shank member and head member and a recess on the other of these members. The recess receives the projection upon turning of the coupling member, and the resilient force provided by the panel is used to tightly seat the projection in the recess.

The invention, together with further features and advantages thereof, may best be understood by reference to the following description taken in connection with the accompanying illustrative drawing.

DESCRIPTION OF THE PREFERRED EMBODIMENT

Figure 1:
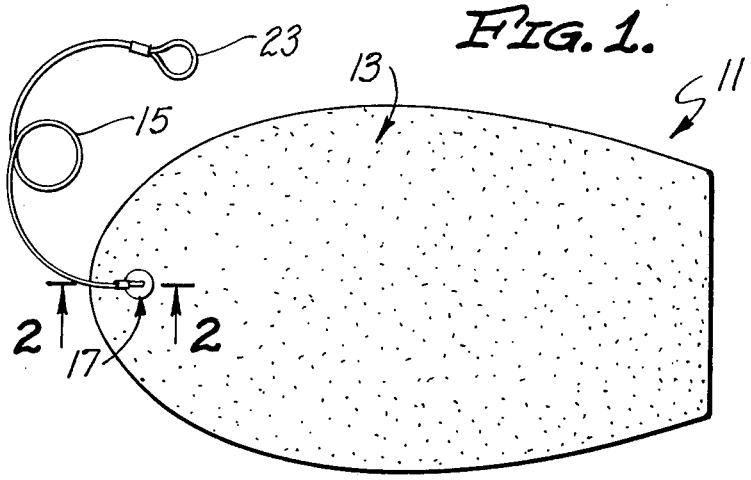
FIG. 1 is a top plan view of a surfing device constructed in accordance with the teachings of this invention.

FIG. 1 shows a surfing device 11 which includes a broad panel 13, a leash 15 and a connector 17 for coupling one end of the leash 15 to the panel 13. The panel 13 is sufficiently buoyant to float in ocean water, and in the embodiment illustrated, it is constructed of a relatively soft, resilient foam plastic material. Although the panel 13 could be a hard surfboard, in the embodiment illustrated, it is in the form of a surf mat sized to permit the surfer to lie on it and ride waves. The panel 13 has an upper face 19 and a lower face 21.

The leash 15, like the panel 13, may be of known construction. In the embodiment illustrated, the leash 15 has means at its outer end permitting the leash to be formed into a loop 23 which can be releasably attached to the wrist of the surfer. The inner end of the leash 15 is attached to the connector 17.

Figure 2:
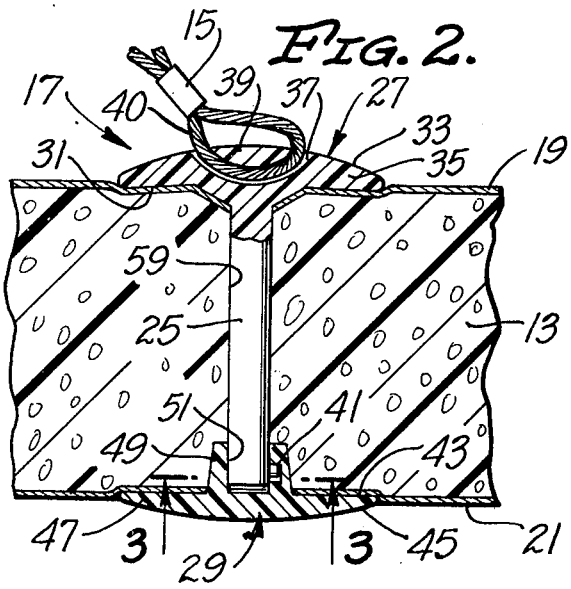
FIG. 2 is an enlarged fragmentary sectional view taken generally along line 2—2 of FIG. 1.
Figure 3:
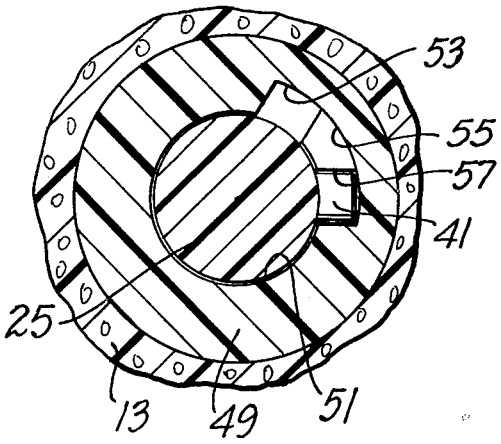
FIG. 3 is an enlarged sectional view taken generally along line 3—3 of FIG. 2.

In the form shown in FIGS. 1–3, the connector 17 includes a shank or shank member 25, a head or head member 27, and a coupling member 29. Each of these components is constructed of a material which is substantially noncorrosive in salt water. For example, nylon or a suitable plastic, such as polypropylene can be utilized.

The head 27 is preferably integral with the shank 25 and includes an inner surface 31 confronting and engaging the upper face 19 and a smooth, exposed outer surface 33. The outer surface 33 may be considered to include all surfaces of the head 27 other than the inner surface 31. The head 27 includes an axially thin flange 35 which defines a major portion of the head, including its periphery.

Although the leash 15 can be attached to any of the members of the connector 17, in the embodiment illustrated, it is attached to the head 27. For this purpose, the head 27 includes a tunnel or passage 37 through which the leash 15 can extend, whereby the leash is attached to a web 39 of the head by a loop 40 at the end of the leash.

The shank 25 is elongated and cylindrical, although it may have other cross-sectional configurations. The shank 25 preferably extends transverse to the head 27, and it carries a radial projection 41 adjacent its free end.

The coupling member 29 has an inner surface 43 which confronts the lower face 21 and a smooth, outer surface 45 which defines the exposed surface portion of the coupling member. The coupling member 29 has an axially thin flange 47 which defines the outer periphery of the coupling member.

The coupling member 29 also includes an axial boss 49 having an axial passage 51 therein sized to receive the outer end portion of the shank 25. To accommodate the radial projection 41, the boss 49 has an axial groove 53 (FIG. 3) which terminates at its lower end in a recess 55 which extends circumferentially and terminates in a recess 57 of sufficient size to accommodate the projection 41. In the position shown in FIGS. 2 and 3, the projection 41 lies within the recess 57 to lock the coupling member 29 to the shank 25.

The length of the shank 25 is selected so that, in the locked position of FIG. 2, a region of the plastic material of the panel 13 is resiliently compressed between the head 27 and the coupling member 29. The reaction force resulting from compressing this region of the panel 13 tightly retains the projection 41 in the recess 57, and the greater the reaction force, the tighter the projection is retained within the recess. Another advantage of some compression of the panel 13 is that the flanges 35 and 47 are countersunk in the panel 13 so that the outer surfaces 33 and 45 are made more nearly flush with the faces 19 and 21. In addition, the thinness of the flanges 35 and 47 also contributes to the head and coupling member being substantially flush with the associated faces of the panel 13.

To install the connector 17, a passage 59 is established through the panel 13, and the shank 25 is inserted to substantially the position shown. The coupling member 29 is inserted from the opposite side of the panel 13, and the outer end of the shank 25 is received in the axial passage 51. The projection 41 is received within the axial groove 53. The coupling member 29 and the head 27 are then manually urged toward each other to compress the material of the panel 13 somewhat until the projection 41 registers with the recess 55. At this time, the coupling member 29 and the shank 25 are relatively rotated to bring the projection 41 into registry with the recess 57 whereupon the compressed material of the panel 13 can expand slightly to snap the projection into the recess 57. If it is desired to remove the connector 17, the procedure described above is reversed.

Figure 4:
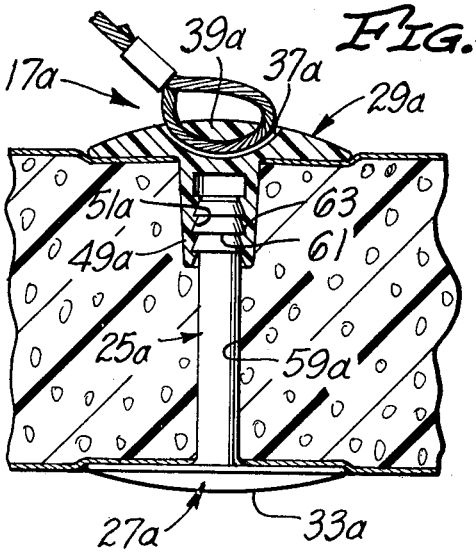
FIGS. 4 and 5 are sectional views similar to FIG. 2, respectively, showing second and third forms of connectors constructed in accordancae with the teachings of this invention.

FIG. 4 shows a surfing device **11*a* which is identical to the surfing device 11 in all respects not shown or described herein. Portions of the surfing device 11 corresponding to portions of the surfing device 11*a*** are designated by corresponding reference numerals followed by the letter "a."

The primary differences between the connector **17*a* and the connector 17 are that the former has interlocking annular teeth 61 and 63, respectively, for attaching the coupling member 29*a* to the shank 25*a* in lieu of the projection 41 and the recess 57. The teeth 61 and 63 are urged into tighter engagement by the resilient force from the panel 13. One advantage of the construction of FIG. 4 is that the user can select the degree of compression of the panel 13 by how far the shank 25*a* is forced into the passage 51*a*. Thus, more than one panel thickness can be accommodated by the connector 17*a***.

Another difference which is embodied in the construction of FIG. 4 is that the coupling member **29*a* is at the upper face 19 of the panel 13*a*. In addition, the coupling member 29*a* contains the passage 37*a* and the web 39*a* to permit the leash 15*a*** to be attached to it.

Figure 5:
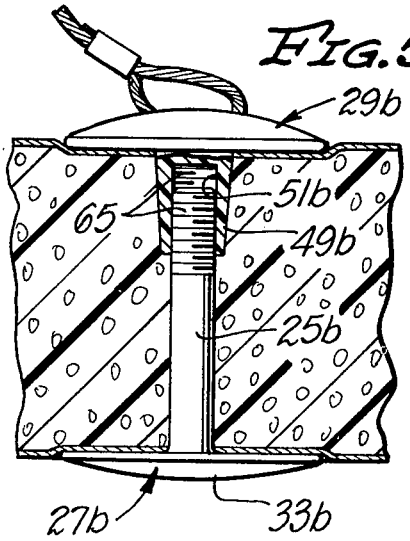

FIG. 5 shows a surfing device **11*b* which is identical to the surfing device 11*a*, except that with the former, screw threads 65 replace the teeth 61 and 63. The threads 65 enable the user to select the degree of compression of the panel 13 and enable the connector 17*b* to be used for various panel thicknesses. In addition, the connector can be disassembled by unscrewing the threads 65. However, the resilient reaction force applied to the connector 17*b* by the panel 13*b* does not serve to lock the threads together more tightly. Portions of the surfing device 11*b* corresponding to portions of the surfing device 11*a*** are designated by corresponding reference numerals with the letter "b" replacing the letter "a."

Although exemplary embodiments of the invention have been shown and described, many changes, modifications and substitutions may be made by one having ordinary skill in the art without necessarily departing from the spirit and scope of this invention:

I claim:

1. A surfing device comprising:

a panel which is sufficiently buoyant to float in water, said panel having first and second faces;

a connector including a shank member and a head member coupled to one end of the shank member;

said head member having an inner surface which confronts said first face of said panel and an exposed smooth outer surface, said shank member projecting into said panel and extending toward said second face of said panel;

said connector including a coupling member having a passage therein which receives the other end of the shank member and means for attaching the coupling member to the shank member adjacent said other end thereof with said other end of said shank member being received by said passage;

said coupling member having an inner surface which confronts the second face of the panel whereby the head member and the coupling member are separated by said panel and the connector is attached to said panel, said coupling member having an exposed smooth outer surface;

a leash; and means for attaching the leash to at least one of said members whereby the connector attaches the leash to the panel.

2. A surfing device as defined in claim 1 wherein at least a portion of said panel is resiliently compressible across its thickness, said connector is attached to said panel at said resilient portion, and at least a region of said resilient portion of said panel is compressed between said inner surfaces of said head member and said coupling member.

3. A surfing device as defined in claim 2 wherein the resilient compression of said region of said panel urges said head member and said coupling member away from each other and said attaching means includes means responsive to the urging of said head member and said coupling member away from each other for more tightly attaching the coupling member to the shank member.

4. A surfing device as defined in claim 3 wherein the coupling member can turn relative to the shank member at least when the shank member is inserted a predetermined amount into said passage of said coupling member and said attaching means includes means defining a recess on said coupling member communicating with said passage and means defining a projection on said shank member, said projection being receivable in said recess upon turning of the coupling member relative to the shank and the forcing of the coupling member and the head member away from each other by said region of said panel tending to maintain the projection in the recess.

5. A surfing device as defined in claim 2 wherein each of said connector member and said head member includes a thin flange defining at least the periphery of the associated member and each of said flanges is substantially flush with the associated face of the panel, said connector being substantially non-corrosive in ocean water.

6. A surfing device as defined in claim 1 wherein said attaching means includes screw threads on said shank member and said coupling member.

7. A surfing device as defined in claim 1 wherein said attaching means includes cooperating interlocking teeth in said passage of said coupling member and on said shank member for retaining the coupling member on the shank member.

8. An apparatus connectible to a surfing device, said apparatus comprising:

a shank member having first and second ends;

a head having a smooth outer surface;

means for attaching the head to the first end of the shank member with the smooth surface facing outwardly;

a coupling member having a passage therein sized to receive the second end of the shank member whereby the second end of the shank member can be advanced into the passage;

interlocking means for attaching the coupling member to said shank member with the second end of said shank member received in said passage;

said interlocking means including a radial projection on one of said members and a cooperating groove and a cooperating recess on the other of said members, said groove being sized to receive the projection as the second end of the shank member is advanced into the passage, said groove opening into said passage and leading to said recess, said coupling member and said shank being relatively rotatable to circumferentially advance the projection into the recess whereby with said projection in said recess, any force tending to move the head away from the coupling member seats the projection more tightly in the recess to more securely attach the coupling member to the shank member;

a leash; and a passage in one of said head and said coupling member through which at least a portion of the leash can pass and means including said portion of said leash for attaching said leash to at least one of said coupling member, said head, and said shank member.

9. An apparatus as defined in claim 8 wherein said projection is on said shank member and said groove and said recess are in said coupling member, said projection extends radially and said recess communicates with said passage in the coupling member, said members and said head being constructed of a material which is substantially non-corrosive in ocean water.

* * * * *